US005994005A

United States Patent [19]

Anderson et al.

[11] Patent Number: 5,994,005

[45] Date of Patent: Nov. 30, 1999

[54] STAIN RESISTANT PROTECTIVE OVERCOAT FOR IMAGED PHOTOGRAPHIC ELEMENTS

[75] Inventors: Charles C. Anderson, Penfield; Brian A. Schell, Honeoye Falls, both of N.Y.

[73] Assignee: Eastman Kodak Company, Rochester, N.Y.

[21] Appl. No.: 09/019,092

[22] Filed: Feb. 5, 1998

[51] Int. Cl.[6] ..... G03K 1/89; G03K 1/85; G03K 1/76

[52] U.S. Cl. ..... 430/11; 430/18; 430/531; 430/533; 430/961; 430/527; 430/530

[58] Field of Search ..... 430/11, 18, 533, 430/531, 527, 961, 530

[56] References Cited

U.S. PATENT DOCUMENTS

| | | | |
|---|---|---|---|
| 4,229,524 | 10/1980 | Yoneyama et al. | 430/536 |
| 5,756,273 | 5/1998 | Wang et al. | 430/537 |

*Primary Examiner*—Mark F. Huff
*Attorney, Agent, or Firm*—Carl F. Ruoff

[57] ABSTRACT

The present invention is an imaged photographic element including a support, having at least one silver halide emulsion layer, and having at least one stain resistant overcoat layer. The stain resistant overcoat layer contains a fluoro (meth)acrylate interpolymer having two different segments, one of which is fluorinated and oleophobic and the other of which is hydratable. The stain resistant overcoat is applied to the photographic element after film processing.

10 Claims, No Drawings

STAIN RESISTANT PROTECTIVE OVERCOAT FOR IMAGED PHOTOGRAPHIC ELEMENTS

CROSS REFERENCE TO RELATED APPLICATIONS

This application relates to commonly assigned copending application Ser. No. 09/019,093 filed simultaneously herewith and hereby incorporated by reference for all that it discloses. This application relates to commonly assigned copending application Ser. No. 09/018,867 filed simultaneously herewith and hereby incorporated by reference for all that it discloses.

FIELD OF THE INVENTION

This invention relates to an imaged photographic element comprising a support material, and having thereon, at least one image-forming layer and at least one outermost stain resistant layer containing a fluoropolymer. The stain resistant layer is applied after film processing.

BACKGROUND OF THE INVENTION

In the photographic industry the need to protect a photographic film or paper from dirt and dust, scratches and abrasion, and deposition of stains has long been recognized. Significant progress has been made in the prevention of dirt and dust attraction through the use of antistatic layers in photographic elements. Improved protective overcoats have reduced the propensity for photographic elements to be scratched or abraded during manufacture and use. However, there is still a need to improve the stain resistance of imaged photographic elements.

A wide variety of substances may adsorb onto or absorb into either the front or back surface of imaging elements and cause a permanent stain that degrades image quality. The deposition of these stain causing substances onto an imaging element may occur in many different ways. For example, dirt, fingerprints, and grease may be deposited onto the imaging element during handling. An imaging element may be stained when it comes in contact with a dirty surface or as a result of an accidental spill from, for example, a liquid drink such as coffee or soda. Other stains may be deposited onto a wet photographic element during film processing. For example, a tar-like material which is derived mostly from polymeric oxidized developer and which may be present at the surface of or on the walls of film processing solution tanks may be deposited during film processing. This tar may adhere to or diffuse into the surface layer of the imaging element and cause an extremely difficult to remove, brown-colored stain.

The treatment of articles such as textiles and food containers with soil and stain resistant compositions is well known. For example, U.S. Pat. Nos. 3,574,791 and 3,728,151 disclose block or graft copolymers which have two different segments, one of which is highly fluorinated and oleophobic and the other of which is hydrophilic. U.S. Pat. No. 4,579,924 describes fluorochemical copolymers useful as paper making additives which impart oil and water repellancy and food stain resistance to ovenable paperboard food containers. U.S. Pat. No. 5,350,795 describes aqueous and oil repellent compositions which cure at ambient temperature. The compositions comprise an aqueous solution or dispersion of a fluorochemical acrylate copolymer and a polyalkoxylated polyurethane having pendant perfluoroalkyl groups. U.S. Pat. No. Re. 34,348 discloses stain resistant compositions containing fluorinated polymers derived from acrylamide-functional monomers. Fluorocarbon containing coatings for hard tissue and surfaces of the oral environment that reduce staining and adhesion of bacteria and proteinaceous substances are described in U.S. Pat. Nos. 5,662,887 and 5,607,663.

For an imaging element the requirements for a stain resistant overcoat are rather unique. The stain resistant layer must not effect the transparency, color, or other imaging properties of the film. The overcoat layer must provide stain resistance when applied as a submicron-thick layer and protect against common stains such as grease and food and drink products.

The present invention relates to improving the stain resistance of imaging elements by providing a thin, outermost layer that resists permanent staining by dirt, grease, food and drink products, etc.

Further, the stain resistant outermost layer of the invention does not degrade the transparency, frictional characteristics, or other physical properties of the imaging element, and may be applied from solvent or aqueous media at low cost.

SUMMARY OF THE INVENTION

In accordance with the present invention, an imaged photographic element comprises a support, at least one silver halide light sensitive layer, and at least one outermost stain resistant layer containing a fluoropolymer. The fluoropolymer is a fluoro(meth)acrylate interpolymer with at least two different segments, one of which is fluorinated and oleophobic and the other of which is hydratable. The stain resistant layer is applied after film processing.

DETAILED DESCRIPTION OF THE INVENTION

The stain resistant layers of the invention contain a fluoro(meth)acrylate interpolymer with at least two different segments, one of which is fluorinated and oleophobic and the other of which is hydratable. These layers are applied after film processing to protect the processed photographic film from damage due to handling or spills. The stain resistant layers of the invention are applied as very thin layers which do not affect the transparency or color of the film and resist permanent stains such as grease, fingerprints, ink, food or drink products. The stain resistant layers may be applied as the outermost layer on the imaging side of the film, on the side opposite to the imaging side, or on both sides of the film.

The photographic elements of this invention can be of many different types depending on the particular use for which they are intended, for example, photographic film, photographic paper, black-and-white photographic film or paper, color photographic film or paper, negative or reversal photographic film, graphic arts film or paper, X-ray film, motion picture film, and the like. Details with respect to the composition and function of a wide variety of different photographic elements are provided in U.S. Pat. No. 5,300,676 and references described therein.

Photographic elements can comprise various polymeric films, papers, glass, and the like, but both acetate and polyester supports and resin coated paper are preferred. The thickness of the support is not critical. Support thickness of 2 to 10 mil (0.002 to 0.010 inches) can be used. The polyester supports typically employ an undercoat or subbing layer well known in the art that comprises, for example, for polyester support a vinylidene chloride/methyl acrylatc/itaconic acid terpolymer or vinylidene chloride/acrylonitrile/acrylic acid terpolymer.

The stain resistant coatings of the invention comprise a vinylic interpolymer having repeat units of A and B where A is derived from fluorine-containing acrylate or methacrylate monomers and B is derived from ethylenically unsaturated monomers containing hydratable groups.

More specifically, the unit A is derived from a fluoro (meth)acrylate or mixture of fluoro(meth)acrylates represented by the following formula:

$$(R_f)_pLOCOCR{=}CH_2$$

where the $R_f$ substituent is a monovalent, fluorinated, aliphatic organic radical having at least one carbon atom and as many as 20 carbon atoms, preferably, 2 to 10 carbon atoms. The skeletal chain of $R_f$ can be straight, branched, or cyclic, and can include catenary divalent oxygen atoms or trivalent nitrogen atoms bonded only to carbon atoms. Preferably, $R_f$ is fully fluorinated, but carbon-bonded hydrogen or chlorine atoms can be present as substituents on the skeletal chain of $R_f$. Preferably, $R_f$ contains at least a terminal perfluoromethyl group. Preferably, p is 1 or 2.

The linking group L is a bond or hydrocarbyl radical linkage group containing from 1 to 12 carbon atoms and optionally substituted with and/or interrupted with a substituted or unsubstituted heteroatom such as O, P, S, N. R is either H or methyl. Preferably, the fluoro(meth)acrylate monomer contains at least 30 weight percent fluorine.

Non-limiting examples of fluoro(meth)acrylates useful in the present invention include:

$$CF_3(CF_2)_x(CH_2)_yOCOCR{=}CH_2$$

where x is 0 to 20, preferably 2 to 10, y is 1 to 10, and R is H or methyl $$HCF_2(CF_2)_x(CH_2)_yOCOCR{=}CH_2$$

where x is 0 to 20, preferably 2 to 10, y is 1 to 10, and R is H or methyl

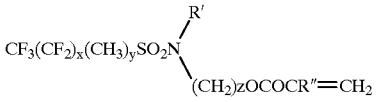

where x is 0 to 20, preferably 2 to 10, y is 1 to 10, z is 1 to 4, R' is alkyl or arylalkyl, and R" is H or methyl

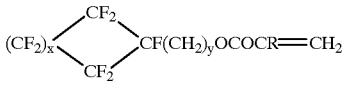

where x is 1 to 7, y is 1 to 10, and R is H or methyl $$CF_3(CF_2CF_2O)_x(CF_2O)_y(CH_2)_zOCOCR{=}CH_2$$

where x+y is at least 1 up to 20, z is 1 to 10, and R is H or methyl.

The B unit is derived from ethylenically unsaturated monomers containing hydratable, ionic or hydratable, nonionic groups or combinations of hydratable ionic and hydratable, nonionic groups. Monomers containing hydratable, ionic groups include mono- or multifunctional carboxyl containing monomers represented by the following formula:

$$CH_2{=}CRL(COOH)_x$$

where R is H, methyl, ethyl, carboxy, carboxymethyl, or cyano, L is a bond or hydrocarbyl radical linkage group containing from 1 to 12 carbon atoms and optionally substituted with and/or interrupted with a substituted or unsubstituted heteroatom such as O, P, S, N. x equals 1 or 2. This unit may be present in its protonated acid forin or salt form after neutralization with an organic or inorganic base.

The B unit may also be derived from ethylenically unsaturated monomers containing sulfonic acid groups, such as vinyl sulfonic acid, styrene sulfonic acid, 2-acrylamido-2-methyl propane sulfonic acid, and the like. Alternatively, the B unit may be derived from ethylenically unsaturated monomers containing phosphorous acid or boron acid groups. Thes units may be present in their protonated acid form or salt form.

The B unit may be derived from substituted or unsubstituted ammonium monomers such as N,N,N-trialkylammonium methyl styrene, N,N,N-trialkylammonium alkyl (meth)acrylate, N,N,N-trialkylammonium (meth)acrylamide, etc., where the counterion may be fluoride, chloride, bromide, acetate, propionate, laurate, palmitate, stearate, etc.

The B unit may further be derived from ethylenically unsaturated monomers containing nonionic, hydrophilic groups. Suitable monomers include: mono- or multifunctional hydroxyl containing monomers such as hydroxyalkyl (meth)acrylates and N-hydroxyalkyl (meth)acrylamides; poly(oxyalkylene)-containing (meth)acrylates and poly (oxyalkylene)-containing itaconates, (meth)acrylamide, and vinyl pyrrolidone.

Preferably, the monomer containing nonionic, hydrophilic groups is a (meth)acrylate containing a poly(oxyalkylene) group in which the oxyalkylene unit has 2 to 4 carbon atoms, such as —$OCH_2CH_2$—, —$OCH_2CH_2CH_2$—, —$OCH(CH_3)CH_2$—, or —$OCH(CH_3)CH(CH_3)$—. The oxyalkylene units in said poly(oxyalkylene) being the same, as in poly (oxypropylene), or present as a mixture, as in a heteric straight or branched chain of blocks of oxyethylene units and blocks of oxypropylene units. The poly(oxyalkylene) group contains 4 to about 200, preferably, 5 to about 150 oxyalkylene units. A representative example of a poly (oxyalkylene)-containing meth(acrylate) suitable for the purpose of the present invention is represented by the following formula:

$$CH_2{=}CR'COO(CH_2CH_2O)_xR''$$

where R' and R" are independently H or methyl, x is 4 to 200.

The fluoro(meth)acrylate interpolymers of the invention comprise 10 to 90 weight % of units A and 10 to 90 weight % of units B. Non-interfering amounts of monomers other than those described above can also be incorporated into the fluoro(meth)acrylate interpolymers of this invention. For example, the interpolymers of this invention can contain up to about 50 weight percent of polymer units derived from ethylene, vinyl acetate, vinyl halide, vinylidene halide, acrylonitrile, methacrylonitrile, alkyl acrylates, alkyl methacrylates, glycidyl acrylate, glycidyl methacrylate, styrene, alkyl styrenes, vinylpyridine, vinyl alkyl ethers, vinyl alkyl ketones, butadiene, vinyl silanes, and mixtures thereof.

The fluoro(meth)acrylate interpolymers of the invention may be random, graft, or block copolymers. The molecular weight of the interpolymers may be from about 5000 to about 10,000,000.

The stain resistant overcoat layers of the present invention may comprise the fluoro(meth)acrylate interpolymer in combination with another polymer. In a preferred embodiment, the other polymer is a water soluble or water dispersible polymer. Water soluble polymers include, for example, gelatin, polyvinyl alcohol, polyvinyl pyrrolidone, cellulosics, poly styrene sulfonic acid and its alkali metal salts or ammonium salts, water soluble (meth)acrylic interpolymers, and the like. Water dispersible polymers that may be used in conjunction with the fluoro(meth)acrylate interpolymer include latex interpolymers containing ethylenically unsaturated monomers such as acrylic and methacrylic acid and their esters, styrene and its derivatives, vinyl chloride, vinylidene chloride, butadiene, acrylamides and methacrylamides, and the like. Other water dispersible polymers that may be used include polyurethane and polyester dispersions. Preferably, the stain resistant overcoat layer contains at least 70 weight % of the fluoro(meth)acrylate interpolymer.

The stain resistant overcoat layer compositions in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with the functional groups present on the fluoro(meth)acrylate interpolymer, and/or the other water soluble or water dispersible polymer present in the coating composition.

The stain resistant overcoat layer can contain other additives such as conductive polymers, conductive metal oxide particles, coating aids, charge control surfactants, and lubricants. Useful lubricants include, for example, perfluorinated olefinic polymers, natural and synthetic waxes, silicone fluids, stearamides, oleamides, stearic acid, lauric acid, ethylene glycol distearate, ethylene glycol monostearate, and the like.

The stain resistant overcoat layers of the present invention may be applied from coating formulations containing up to 20% total solids by coating methods well known in the art. For example, hopper coating, gravure coating, skim pan/air knife coating, spray coating, roller pan coating, dip coating, and other methods may be used with very satisfactory results. The coatings may also be applied from a soft tissue or cloth that has been premoistened with a solution or dispersion containing the stain resistant coating compositions of the invention. The coatings are applied at a dry coating weight of about 1 $mg/m^2$ to about 5000 $mg/m^2$, preferably, the dry coating weight is about 2 $mg/m^2$ to about 500 $mg/m^2$. The interpolymers may be applied from solvent or water-based coating formulations. Preferably, the fluoro (meth)acrylate interpolymers of the invention are water soluble or water dispersible and are applied from a water-based formulation.

The photographic elements of this invention are photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The photographic processing steps to which the raw film may be subject may include, but are not limited to the following:

1.) color developing→bleach-fixing→washing/stabilizing;
2.) color developing→bleaching→fixing→washing/stabilizing;
3.) color developing→bleaching→bleach-fixing→washing/stabilizing;
4.) color developing→stopping→washing→bleaching→washing→fixing→washing/stabilizing;
5.) color developing→bleach-fixing→fixing→washing/stabilizing;
6.) color developing→bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention is also directed to photographic systems where the processed element may be re-introduced into the cassette. These system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The following examples are used to illustrate the present invention. However, it should be understood that the invention is not limited to these illustrative examples.

EXAMPLES

Examples 1 to 3 and Comparative Sample A

Comparative Sample A comprises the imaged (and processed) color photographic film without a stain resistant overcoat. Example 1 comprises a fluoro(meth)acrylate containing anionic groups, nonionic, hydrophilic groups, and silanol groups available under the tradename Fluorad FC-759 from 3M Company. Examples 2 and 3 comprise copolymers of a perfluoroalkyl (meth)acrylate and a polyoxyalkylene acrylate available under the tradenames Scotchban FC-829A and FC-808, respectively, both from 3M Company. These coatings were applied from an aqueous formulation containing 0.6 weight % solids onto the imaged and processed color photographic emulsion layer and dried at 50° C. The total dry coating weight for the stain resistant coatings was 150 mg/m$^2$.

The stain resistance for the samples was tested by depositing food and drink products (ketchup and black coffee) onto the overcoat layer using a cotton swab. These products were left on the sample for 5 minutes and then the sample was rinsed with distilled water and wiped gently several times with a soft tissue that had been moistened in distilled water. Examples 1, 2, and 3 of the invention showed no stains after rinsing with distilled water and then wiping gently with a moist cloth. On the other hand, Comparative Sample A showed both coffee stains and ketchup stains remaining even after fairly vigorous wiping with a moist tissue. The imaging side of Examples 1 to 3 and Comparative Sample A were also marked with a black ink marker ("Sharpie" permanent marker available from Sanford). All four samples gave dry black markings that were dry to the touch and did not smear. The ink marks on Examples 1, 2, and 3 were easily removed with gentle rubbing under running water. The ink mark on Comparative Sample A could not be removed under running water even with more vigorous rubbing.

The results described above clearly show that the imaged photographic elements of the invention containing a fluoro (meth)acrylate overcoat have superior resistance to permanent stains compared with an imaged photographic element that does not have a stain resistant overcoat. The invention has been described in detail with particular reference to certain preferred embodiments thereof, but it will be understood that variations and modifications can be effected within the spirit and scope of the invention.

What is claimed is:

1. An imaged and processed photographic element comprising a support, at least one imaged and processed layer superposed on a side of said support, and an outermost stain resistant overcoat superposed on said imaged and processed layer comprising a fluoro(meth)acrylate interpolymer having repeating units of A and B wherein A comprises a fluorine containing acrylate or methacrylate monomer and B comprises an ethylenically unsaturated monomer containing hydratable groups.

2. The imaged and processed photographic element of claim 1, wherein A is represented by the following formula:

$$(R_f)_pLOCOCR{=}CH_2$$

wherein $R_f$ is a monovalent, fluorinated, aliphatic organic radical having from one to 20 carbon atoms, p is 1 or 2, L is a bond or hydrocarbyl radical linkage group containing from 1 to 12 carbon atoms and R is either H or methyl.

3. The imaged and processed photographic element of claim 1, wherein B is represented by the following formula:

$$CH_2{=}CRL(COOH)_x$$

wherein R is hydrogen, methyl, ethyl, carboxy, carboxymethyl, or cyano, L is a bond or hydrocarbyl radical linkage group containing from 1 to 12 carbon atoms, where x is 1 or 2.

4. The imaged and processed photographic element of claim 1, wherein B is an ethylenically unsaturated monomer containing sulfonic acid groups, phosphorous acid groups, boron acid groups, or nonionic hydrophilic groups.

5. The imaged and processed photographic element of claim 1, wherein said interpolymer comprises from 10 to 90 wt % of units A and from 10 to 90 weight % of units B.

6. The imaged and processed photographic element of claim 1, wherein said interpolymer further comprises ethylene, vinyl acetate, vinyl halide, vinylidene halide, acrylonitrile, methacrylonitrile, glycidyl acrylate, alkyl acrylates, alkyl methacrylates, glycidyl methacrylate, styrene, alkyl styrene, vinylpyridine, vinyl alkyl ether, vinyl alkyl ketone, butadiene or vinyl silane.

7. The imaged and processed photographic element of claim 1, wherein said interpolymers have a molecular weight of from about 5000 to about 10,000,000.

8. The imaged and processed photographic element of claim 1, wherein said outermost stain resistant overcoat layer further comprises a water soluble or water dispersible polymer.

9. The imaged and processed photographic element of claim 8, wherein said outermost stain resistant overcoat layer comprises at least 70 weight % of the fluoro(meth) acrylate interpolymer.

10. The imaged and processed photographic element of claim 1, wherein said overcoat further comprises crosslinking agents, conductive polymers, conductive metal oxide particles, coating aids, charge control surfactants, or lubricants.

* * * * *